United States Patent [19]

Nasby, Jr.

[11] Patent Number: 4,589,800

[45] Date of Patent: May 20, 1986

[54] DOCK STRUCTURE AND METHOD AND APPARATUS FOR RAISING AND LOWERING SAME

[76] Inventor: Charles L. Nasby, Jr., 4624 Bruce Ave. South, Minneapolis, Minn. 55424

[21] Appl. No.: 717,386

[22] Filed: Mar. 29, 1985

[51] Int. Cl.[4] ..... E02B 3/20

[52] U.S. Cl. ..... 405/221; 182/148

[58] Field of Search ..... 405/3, 196, 218, 221; 114/45, 263; 182/142, 143, 144, 148

[56] References Cited

U.S. PATENT DOCUMENTS

| | | | |
|---|---|---|---|
| 2,890,082 | 6/1959 | McDaniel et al. | 182/144 |
| 2,904,126 | 9/1959 | Meng et al. | 182/148 X |
| 3,380,257 | 4/1968 | Gillman et al. | 405/221 |
| 4,019,212 | 4/1977 | Downer | 405/3 X |

OTHER PUBLICATIONS

Sketch, Central Machine and Tool, 1234 Central Avenue, NE, Minneapolis, MN.

Brochure, A & G Sales, "Water-Free Docks on Wheels".

Brochure, Newman Dock.

*Primary Examiner*—David H. Corbin

*Attorney, Agent, or Firm*—Merchant, Gould, Smith, Edell, Welter & Schmidt

[57] ABSTRACT

A dock structure (10) supported by a support structure (29) being movable relative to the support structure (29) by sleeve-like tubular members (33*a, b*) mounted on elongated upright support members (32*a, b*) of the support structure (29). The dock structure (10) being raised and lowered by a winch assembly (50) including a winch (51) removably mounted on one of the elongated upright support members (32*a, b*) and interconnected to a cable (60) passing under the dock structure (10) and being removably attached to an upper end of the other elongated upright support member (32*a, b*).

10 Claims, 5 Drawing Figures

DOCK STRUCTURE AND METHOD AND APPARATUS FOR RAISING AND LOWERING SAME

BACKGROUND OF THE INVENTION

This invention relates generally to a dock structure and a method and apparatus for raising and lowering the same. In particular, the invention relates to use of a winch mounted on one of the elongated upright support members of the dock structure for raising and lowering the dock structure.

Dock structures suitable for mooring small water craft and for use during swimming and other water related recreational activities have long been produced. An example of such a dock structure is applicant's U.S. Pat. No. 3,824,796. Anyone owning such a dock structure will appreciate the necessity of having to raise and lower the dock structure due to changing water levels. One method and apparatus for raising and lowering such a dock structure is illustrated in U.S. Pat. No. 3,380,257. In addition to many other problems associated with this patent disclosure, in order to operate the winch, a person must reach down below the deck of the dock in order to crank the winch handle. Furthermore, the winch assembly includes a rather complicated arrangement of pulleys and cables, which will require maintenance and repair throughout its lifetime. Additionally, the winch is intended to be permanently attached to the dock structure. The present invention solves these and many other problems associated with U.S. Pat. No. 3,380,257 and other methods and apparatus for raising and lowering dock structures.

SUMMARY OF THE INVENTION

The present invention relates to a dock structure including a deck structure supported by support means. The support means include first and second elongated upright support members positioned on opposite sides of the deck structure. Sleeve means is interconnected to the deck structure and slidably mounted on the first and second elongated upright support members for slidable movement of the deck structure vertically along the first and second elongated upright support members. The sleeve means preferably includes releasable means for fixedly securing the sleeve means against slidable movement along the first and second elongated upright support members at a desired location. A winch is mounted on an upper end of the first elongated upright support member at a location above the deck structure. Cable guide means are mounted on each of the sleeve means for guiding cable therethrough. A cable is attached at a first end to the winch. In addition, means is provided for interconnecting the cable at its second end to an upper end of the second elongated upright support member, the cable extending under the deck structure from the first elongated upright support member to the second elongated upright support member through the cable guide means mounted on the sleeve means such that, upon operation of the winch to shorten the cable, the dock structure will be elevated relative to the first and second elongated upright support members and upon operation of the winch to lengthen the cable, the dock structure will be lowered relative to the first and second elongated upright support members.

The present invention is particularly advantageous in that it is easy to use and relatively inexpensive.

Furthermore, a preferred embodiment of the present invention is removable such that once the deck structure is raised or lowered to its desired height, the winch can be removed and stored, or used to raise another section of the dock, or other docks. In addition, the removable winch can be utilized to facilitate removal of the dock structure from the water by mounting the winch onto an object on the shore and attaching the other end of the cable to the shore end of the dock and then operating the winch to shorten the cable.

Furthermore, the present invention is relatively easy to maintain and repair.

The present invention enables one to raise and lower a dock structure without having to get into the water. This will be greatly appreciated by anyone who has had to get into icy cold water in the spring or the fall to adjust the height of the dock.

These and various other advantages and features of novelty which characterize the present invention are pointed out with particularity in the claims annexed hereto and forming a part hereof. However, for a better understanding of the invention, its advantages and objects attained by its use, reference should be had to the drawings which form a further part hereof, and to the accompanying descriptive matter, in which there is illustrated and described a preferred embodiment of the invention.

BRIEF DESCRIPTION OF THE DRAWINGS

Referring now to the drawings, wherein like characters indicate like parts throughout the several views.

DETAILED DESCRIPTION OF THE PREFERRED EMBODIMENT

Figure 1:
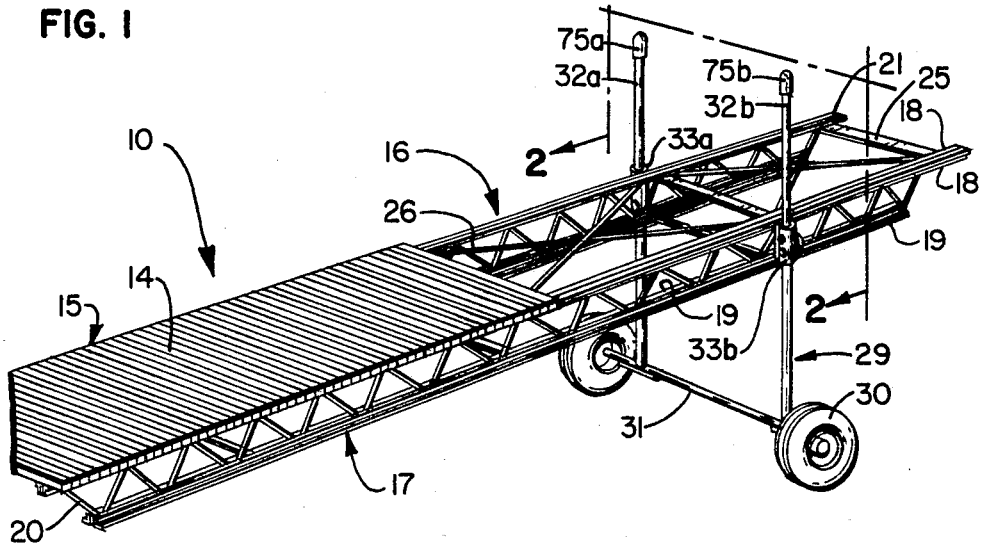
FIG. 1 is a view in perspective of a dock structure, with a portion of the deck structure removed for purposes of illustration.
Figure 2:
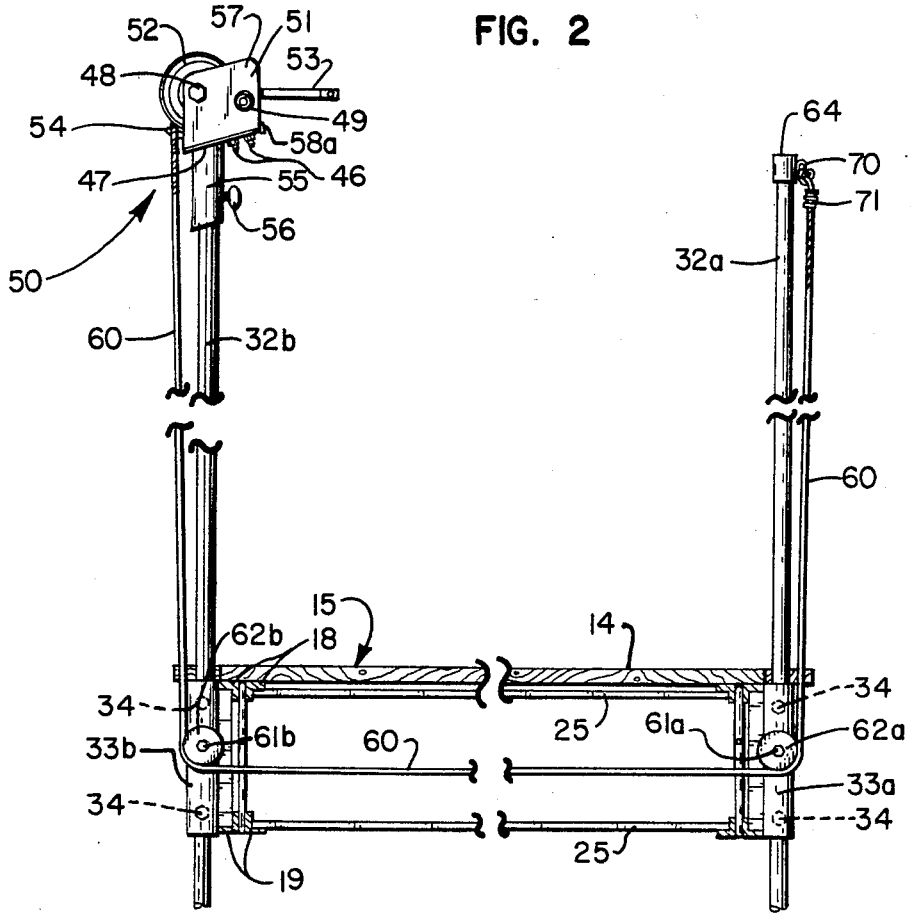
FIG. 2 is an enlarged view as seen generally along line 2—2 of FIG. 1 with an embodiment of a winch assembly removably mounted thereon in accordance with the principles of the present invention.
Figure 3:
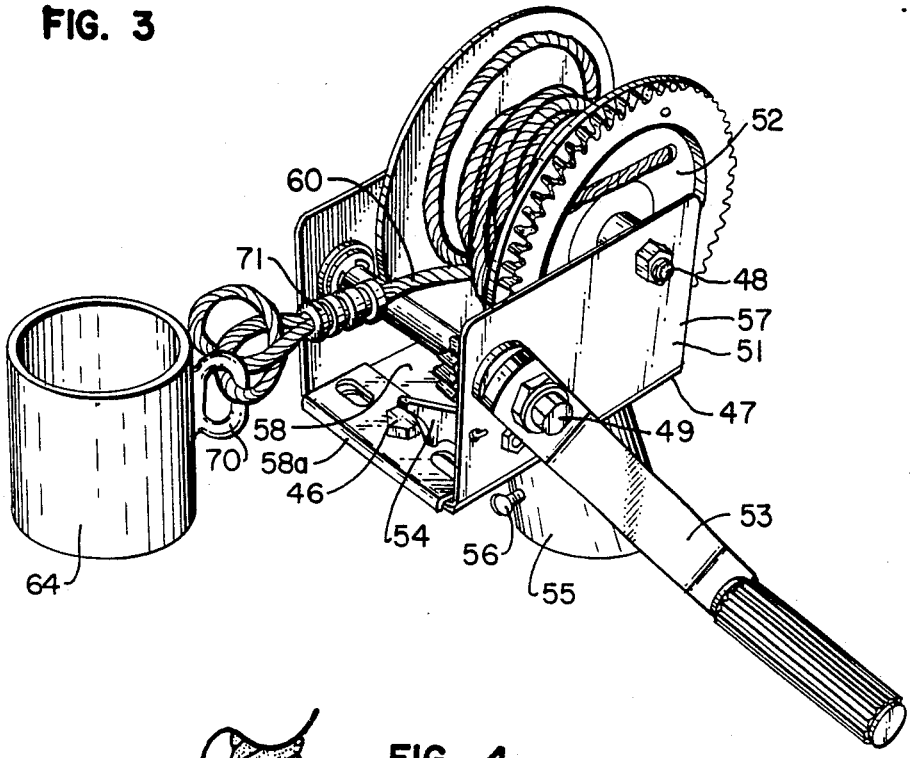
FIG. 3 is a view in perspective of the embodiment of the winch assembly shown in FIG. 2.

Referring now to the drawings, illustrated in FIGS. 1 through 3 is a preferred embodiment of a dock structure, designated generally by the numeral 10, which typically extends into a body of water from an anchoring pad situated adjacent the shoreline of the body of water. The dock structure is shown in FIG. 2 as having a removable winch assembly, generally designated by the reference numeral 50 mounted thereon for raising and lowering a deck structure 15 of the dock structure 10. While only a single dock section is illustrated in FIG. 1, it will be appreciated that the present invention has particular utility on dock structures which include multiple dock sections interconnected to one another. One embodiment of such a multiple section dock structure is illustrated in U.S. Pat. No. 3,824,796.

It it will be appreciated that the present invention might be utilized with any number of dock structures. In the embodiment shown, the deck structure 15 includes a reinforcement structure 16. The reinforcement structure 16 of the deck structure 15 illustrated in FIG.

1 includes a pair of longitudinally extending bar joists 17. The bar joists 17 are truss-type supporting structures and each include an upper chord element formed of longitudinally extending laterally spaced rail members 18, a lower chord element formed of laterially spaced rail members 19, and angularly disposed connecting elements 20. As was disclosed in U.S. Pat. No. 3,824,796, the angularly disposed connecting elements 20 might be formed from a single length of round bar stock. The laterally spaced rail members 19 might be formed from round bar stock or longitudinally extending angle iron. The laterally spaced rail members 18 of the upper chord element are preferably formed from longitudinally extending angle iron to add lateral stability to the respective bar joists 17 when the bar joists are disposed with the connecting elements lying in a vertical plane. Opposite end portion of the connecting elements 20 are disposed between and secured to the laterally spaced rail members 18, 19 such that the portions of the connecting members 20 disposed between the rail members 18 cooperate therewith to define longitudinally extended slots 21 that are spaced and extend longitudinally of the bar joists 17. In the embodiment of the dock structure 10 shown, a wooden deck 14 of the deck structure 15 is secured to the reinforcement structure 16 by bolts or the like which pass through the wooden deck 14 and selected ones of the longitudinally extended slots 21 formed in each of the bar joists 17. The dock structure 10 might include bracing connecting the bar joists 17 in a general parallel relationship, the bracing including a plurality of bars 25 extending at right angles to the bar joists 17. In addition, transversely extending braces 26 forming an x-brace between the bar joists 17 might be present.

In the preferred embodiment of the dock structure 10 shown in FIG. 1, which is a portable roll dock, a wheel-equipped support structure 29 supports one end of the dock structure 10 with the other end of the dock structure 10 resting on the shoreline or interconnected to another section of dock. The wheel-equipped support structure 29 includes a pair of wheels 30 pivotally mounted on a transversely extending axle 31. Fixedly mounted on the axle 31 are two laterally spaced apart elongated upright support members 32*a*, 32*b*. Each of the elongated upright support members 32*a*, *b* are telescopically received within one of a pair of sleeve-like tubular members 33*a*, *b* to permit vertical adjustment of the wheels 30 toward and away the deck structure 15. The sleeve-like tubular members 33*a*, *b* are secured to the bar joists 17 and extend between an upper and lower chord element of their respective bar joists 17 to provide a maximum degree of support to the wheel-equipped support structure 29 in directions longitudinally to the dock structure 10 with a minimum of angular bracing. A pair of set screws 34 associated with each of the sleeve-like tubular members 33*a*, *b* are used to secure the sleeve-like tubular members 33 at desired locations along the elongated upright support members 32*a*, *b*. As shown, particularly in FIG. 1, the wheel-equipped support structure 29 is spaced from the outer end of the dock structure 10 to provide a cantilevered outer end portion to permit use of the outer end of the dock structure 10 with a minimum of underwater obstacles. However, it will be appreciated that the wheel-equipped support structure 29 might be located at varying locations along the dock structure 10 and that, indeed, multiple wheel-equipped support structures 29 might be present. Furthermore, the support structure might not be wheel-equipped, but rather might have suitable platform supports in place of the wheels.

As illustrated in FIGS. 2 through 3, the winch assembly includes a winch 51 removably mounted on an upper end of one of the elongated upright support members 32*b*. A cable 60 is attached at one end to the winch 51 and extends down alongside the elongated upright support member 32*b* to a pulley 62*b* which serves as a cable guide for the cable 60. The cable 60 then extends transversely from one side of the dock structure 10 to the other side of the dock structure 10 to a pulley 62*a* which also serves as a cable guide. In the embodiment shown, the cable 60 extends under the wooden deck 14 between the upper and lower chord elements of the bar joists 17. It will be appreciated, however, that depending on the configuration of the sleeve-like tubular members 33*a*, *b* and the location of the pulleys 62*a*, *b*, the cable 60 might extend over the top of the wooden deck 14 or at various levels under the deck structure 15. It is preferred that the able 60 extend along an undersurface of the deck structure 15 so as not to obstruct the deck. The cable 60 then extends upwardly along the elongated upright support member 32*a* and is removably interconnected to an upper end of the elongated upright support member 32*a* by a hollow cylindrical end cap 64 which removably inserts over the upper end of the elongated upright support member 32*a*. The pulleys 62*a*, *b* are preferably pivotally mounted to the sleeve-like tubular members 33*a*, *b*. It will be appreciated that this might be accomplished in any number of ways. In the preferred embodiment, a boltlike member 61*a*, *b* is welded to the sleeve-like tubular members 33*a*, *b* with the pulleys 62*a*, *b* pivotally mounted thereon. As illustrated in FIG. 2, the wooden deck 14 of the deck structure 15 may be cut away proximate the elongated upright support members 32*a*, *b* to provide clearance for the cable 60 if the deck structure 15 extends beyond the cable 60.

Although varying configurations of winches might be used, the winch 51 shown includes a journaled drum 52 to which the first end of the cable 60 is attached. The winch 51 further includes a handle 53 and ratchet assembly for turning the drum 52 such that upon turning the winch handle 53 the overall cable length can be lengthened or shortened. In addition, the winch 51 includes a latching mechanism 54 which enables the winch 51 to lock or hold the drum 52 with the cable 60 connected thereto in any desired position such that when the set screws 34 of the sleeve-like tubular members 33*a*, *b* are loosened, the winch 51 will hold the deck structure 15 at a desired height. The winch 51 is mounted on an upper end of the elongated upright support member 32*b* by a hollow cylindrical member 55 which is restricted or enclosed at one end so as to retain the winch 51 at the upper end of the elongated upright support member 32*b*. In the preferred embodiment shown, the cylindrical end cap 55 includes a thumbscrew or the like for limiting rotational or pivotal movement of the winch 51 when it is mounted on the elongated upright support member 32*b*. In the preferred embodiment, the framework of the winch 51 includes two parallel extending plates 57 interconnected by a transversely extending bottom plate 58, including a reinforcement member 58*a*. The drum 52 and the handle 53 are mounted on journaled shafts 48, 49, respectively, extending between the two side walls 57. As illustrated, the cylindrical end cap 55 is preferably mounted to the bottom plate 58 so as to be inclined with respect to the bottom plate 58 such that when mounted on the upper end of the elongated upright support member 32*b*, the winch 51 is angled or tilted slightly downward to enable clearance between the cable 60 and the winch 51. In the embodiment shown, the cylindrical end cap 55 is enclosed by a plate 47 which is attached to the bottom plate 58 of the winch 51 by bolts 46.

The cylindrical end cap 64 in the embodiment shown has a U-shaped member 70 welded thereon. The second end of the cable 60 is then suitably secured to the U-shaped member 70. In the embodiment shown in FIG. 3, the second end of the cable 60 is inserted twice through the U-shaped member 70 and is then secured to the cable 60 by a clamp member 71, or the like.

Figure 4:
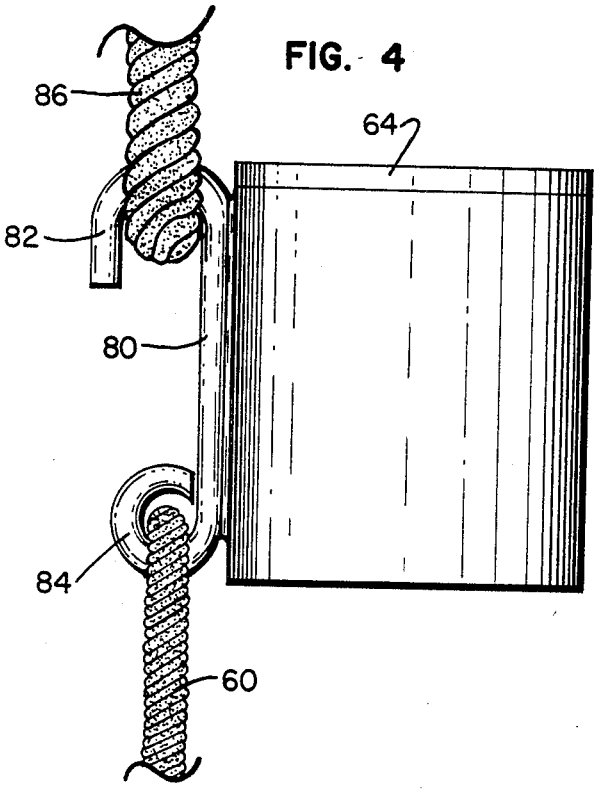
FIG. 4 is an alternate embodiment for attaching the cable to the end cap.
Figure 5:
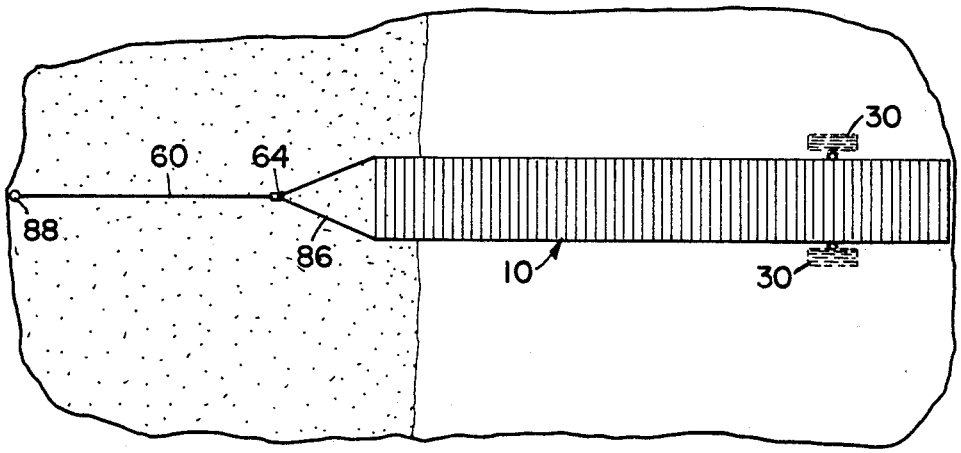
FIG. 5 is a diagrammatic view illustrating use of the winch to remove the dock structure from a body of water.

In an embodiment shown in FIG. 4, a C-shaped member 80 having a hook portion 82 and an eye portion 84 is welded onto the cylindrical end cap 64. The cable 60 is inserted through the eye portion 84 while the hook portion can be used to attach a rope 86 or the like. The C-shaped member 80 absorbs most of the axial load when the winch assembly 50 is used to pull in the dock structure as illustrated in FIG. 5, wherein the winch 51 is removably mounted on a support structure 88 from the shore. The rope 86 is passed through the hook portion 82 and attached to the corners of the dock. It will be appreciated that there are many different ways to mount the winch assembly on land. For example, the winch 51 might be removably mounted on a pipe 88 removably mounted in concrete footing.

As illustrated in FIG. 1, the dock structure 10 of the preferred embodiment has two end cap members 75*a, b* inserted over the upper ends of the elongated upright support members 32*a, b* when the winch assembly 50 is not removably mounted thereon. This prevents water and dirt from getting into the elongated upright support members 32*a, b* and further acts as a safety feature and enhances aesthetic appearance.

In use, the winch 51 is removably inserted over the upper end of the elongated upright support member 32*b*. The cylindrical end cap 64 at the second end of the cable 60 is then passed through under the deck structure 15 and positioned in the pulleys 61*a, b*. The cylindrical end cap 64 is then removably positioned on the upper end of the elongated upright support member 32*a*. It will be appreciated that prior to doing this the end caps 75*a, b* are removed. In addition, this step might be accomplished while the dock is on land, prior to insertion into the lake or other body of water. If the dock is already in the water, a pole or some other elongated object could be used to insert the cable 60 under the deck structure 15 to the opposite side of the dock structure 10. This might be accomplished by mounting the cylindrical end cap 64 onto the end of the pole or other device used. While this will usually eliminate the necessity of getting into the water, it will be appreciated that on certain occasions one might have to get into the water in order to pass the cable 60 under the deck structure 15. Once the dock structure 10 is in the water, the winch assembly 50 could be left mounted on the elongated upright support members, although this is not deemed desirable.

Once the cable has been passed under the deck structure 15 and removably mounted at its second end on the upper end of the elongated upright support member 32*a*, the user will operate the winch by use of the handle 53 to tighten the cable 60. Once the cable 60 has been tightened, the latching mechanism 54 is set to hold the drum 52 in position. The user then loosens the set screws associated with each of the sleeve-like tubular members 33 to enable vertical adjustment of the deck structure 15 relative to the elongated upright support members 32*a, b*. The user then operates the handle 53 of the winch assembly 50 to shorten the cable 60 if the dock structure 10 is to be elevated and to lengthen the cable 60 if the dock structure 10 is to be lowered. Once the deck structure 15 is at its desired height, the user again locks the drum 52 of the winch 51 in position by use of the latching mechansim 54. The user then tightens the thumb-screws 34 to secure the sleeve-like tubular members 33 against further movement along the elongated upright support members 32*a, b*. The user then operates the winch 51 to loosen the cable 60 and, preferably, removes the winch assembly 50 from the elongated upright support members 32*a, b*. The winch assembly 50 can then be used to raise other sections of the dock structure 10 and/or other docks which the user might have. Once finished, the highly portable winch assembly 50 can be readily stored until required for further use.

As previously discussed, the winch assembly 50 might be used to remove the dock structure 10 from the water. This could be accomplished by removably positioning the winch 51 over an elongated upright support member located some distance inland from the shoreline. The second end of the cable 60 could then be attached to the shore end of the dock structure 10 and the winch 51 operated to shorten the cable 60, whereby the dock structure 10 would be pulled out of the water.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention, to the full extent indicated by the board general meaning of the terms in which the appended claims are expressed.

What is claimed is:

1. A dock structure comprising:

(a) a deck structure;

(b) support means for supporting the deck structure, the support means including first and second elongated upright support members positioned proximate opposite sides of the deck structure;

(c) sleeve means interconnected to the deck structure and slidably mounted on the first and second elongated upright support members for providing vertical movement of the deck structure relative to the first and second elongated upright support members, the sleeve means including releasable means for securing as desired the sleeve means against slidable movement along the first and second elongated upright support members;

(d) a winch mounted on the first elongated upright support member at a location above the deck structure;

(e) cable guide means interconnected to the deck structure for guiding cable therethrough;

(f) a cable attached at a first end to the winch; and (g) means for interconnecting the cable at its second end to the second elongated upright support member at a location above the deck structure, the cable extending transversely of the deck structure from the first elongated upright support member to the second elongated upright support member through the cable guide means such that upon operation of the winch to shorten the cable, the deck structure will be elevated relative to the first and second elongated upright support members, and upon operation of the winch to lengthen the cable, the deck structure will be lowered relative to the first and second elongated upright support members.

2. A dock structure in accordance with claim 1, wherein the winch is removably mounted on the first elongated upright support member and the cable is removably interconnected to the second elongated upright support member.

3. A dock structure in accordance with claim 2, wherein the winch includes hollow cylindrical member means for insertion over an upper end of the first elongated upright support member, the hollow cylindrical member means being restricted at one end to retain the winch proximate the upper end of the first elongated upright support member.

4. A dock structure in accordance with claim 3, wherein the cable is removably interconnected to the second elongated upright support member by hollow cylindrical member means for insertion over an upper end of the second elongated upright support member, the hollow cylindrical member means being restricted at one end to retain the cable proximate the upper end of the second elongated upright support member.

5. A dock structure in accordance with claim 3, wherein the cylindrical member means of the winch includes thumb screw means for preventing rotational and pivotal movement of the cylindrical member means relative to the first elongated upright support member.

6. A dock structure in accordance with claim 3, wherein the support means includes wheels pivotally mounted proximate a lower end thereof.

7. A dock structure in accordance with claim 2, wherein the cable extends transversely of the dock structure along an undersurface of the deck structure.

8. A dock structure comprising:

(a) a deck structure including a deck and reinforcement structure along an undersurface of the deck;

(b) wheel-equipped support structure supporting the deck structure, the wheel-equipped support structure including first and second elongated upright support members positioned proximate opposite sides of the deck structure;

(c) first and second sleeve-like tubular members interconnected to the reinforcement structure of the deck structure and slidably mounted on the first and second elongated upright support members respectively for enabling vertical movement of the deck structure relative to the first and second elongated upright support members;

(d) a winch removably mounted on an upper end of the first elongated upright support member at a location above the deck structure, the winch including a hollow cylindrical mounting member adapted to receive the upper end of the first elongated upright support member, the hollow cylindrical mounting member being restricted at one end to retain the winch proximate the upper end of the first elongated upright support member;

(e) first and second pulleys interconnected to the first and second sleeve-like tubular members respectively;

(f) a cable attached at a first end to the winch; and (g) the cable attached at a second end to a hollow cylindrical end cap member adapted to receive an upper end of the second elongated upright support member, the hollow cylindrical end cap member being restricted at one end to limit its insertion onto the upper end of the second elongated upright support member, the cable extending downwardly from the winch to the first pulley and transversely of the deck structure under the deck to the second pulley and upwardly to the hollow cylindrical end cap member such that upon operation of the winch to shorten the cable, the deck structure will be elevated relative to the first and second elongated upright support members, and upon operation of the winch to lengthen the cable, the deck structure will be lowered relative to the first and second elongated upright support members.

9. A dock structure in accordance with claim 8, wherein the cable is attached to the hollow cylindrical end cap member by a C-shaped member having an eye portion and a hook portion.

10. A method for raising and lowering a dock structure including a deck structure and support means for supporting the deck structure, the support means including first and second elongated upright support members positioned proximate opposite sides of the deck structure, the method comprising the steps of:

(a) removably mounting a winch on the first elongated upright support member above the deck structure;

(b) extending a cable affixed at a first end to the winch downwardly to a first cable guide structure interconnected to a first sleeve member slidably disposed on the first elongated upright support member, the first sleeve member being further interconnected to the deck structure to enable movement of the deck structure relative to the support means;

(c) passing the cable transversely of the deck structure from the first cable guide to a second cable guide interconnected to a second sleeve member slidably disposed on the second elongated upright support member, the second sleeve member being further interconnected to the deck structure to enable movement of the deck structure relative to the support means;

(d) extending the cable from the second cable guide upwardly and removably interconnecting a second end of the cable to the second elongated upright support member at a location above the deck structure; and (e) operating the winch to vary the length of the cable whereby, upon shortening the cable, the deck structure is elevated and upon lengthening the cable, the deck structure is lowered.

* * * * *

UNITED STATES PATENT AND TRADEMARK OFFICE

CERTIFICATE OF CORRECTION

PATENT NO. : 4,589,800

DATED : May 20, 1986

INVENTOR(S) : Charles L. Nasby, Jr.

It is certified that error appears in the above-identified patent and that said Letters Patent is hereby corrected as shown below:

Col. 2, line 64, delete the second occurrence of "it".

Col. 3, line 5, delete "laterially" and insert --laterally--.

Col. 3, line 17, delete "portion" and insert --portions--.

Col. 3, line 48, after "away" insert --from--.

Col. 4, line 20, delete "able" and insert --cable--.

Col. 6, line 39, delete "board" and insert --broad--.

Signed and Sealed this

*Ninth* Day of *September 1986*

[SEAL]

*Attest:*

DONALD J. QUIGG

*Attesting Officer*

*Commissioner of Patents and Trademarks*